US006426706B1

(12) United States Patent
King

(10) Patent No.: US 6,426,706 B1
(45) Date of Patent: Jul. 30, 2002

(54) SAFETY WARNING TRANSCEIVER

(75) Inventor: Joseph David King, Ann Arbor, MI (US)

(73) Assignee: Lear Automotive Dearborn, Inc., Southfield, MI (US)

( * ) Notice: Subject to any disclaimer, the term of this patent is extended or adjusted under 35 U.S.C. 154(b) by 0 days.

(21) Appl. No.: 09/196,654

(22) Filed: Nov. 19, 1998

(51) Int. Cl.[7] ..... G08G 1/16

(52) U.S. Cl. ..... 340/903; 340/902; 340/904; 340/905; 340/901; 340/932

(58) Field of Search ..... 340/902, 903, 340/901, 904, 905, 932; 180/167

(56) References Cited

U.S. PATENT DOCUMENTS

| | | | | |
|---|---|---|---|---|
| 3,854,438 A | | 12/1974 | Soto | 116/28 |
| 5,091,726 A | | 2/1992 | Shyu | 340/904 |
| 5,162,794 A | | 11/1992 | Seith | 340/525 |
| 5,302,956 A | | 4/1994 | Asbury et al. | 340/525 |
| 5,357,438 A | | 10/1994 | Davidian | 340/525 |
| 5,424,726 A | | 6/1995 | Beymer | 340/525 |
| 5,442,340 A | | 8/1995 | Dykema | 340/825.22 |
| 5,479,155 A | | 12/1995 | Zeinstra et al. | 340/825.22 |
| 5,583,485 A | | 12/1996 | Van Lente et al. | 340/425.5 |
| 5,614,891 A | | 3/1997 | Zeinstra et al. | 340/825.69 |
| 5,661,804 A | | 8/1997 | Dykema et al. | 380/274 |
| 5,684,474 A | | 11/1997 | Gilon et al. | 340/435 |
| 5,781,119 A | * | 7/1998 | Yamashita et al. | 340/903 |

* cited by examiner

*Primary Examiner*—Daryl Pope
(74) *Attorney, Agent, or Firm*—Niro, Scavone, Haller & Niro

(57) ABSTRACT

A safety warning system includes a safety warning transceiver which retransmits safety warning signals received by the safety warning transmitter in order to extend the range of safety warning transmitter systems. The safety warning transceiver also functions as a trainable garage door opener and interacts with the remote keyless entry system of the vehicle. In one embodiment, the safety warning transceiver can be installed and selectively removed from a docking station in the vehicle in order to prevent theft or install the safety warning transceiver into another vehicle.

30 Claims, 1 Drawing Sheet

SAFETY WARNING TRANSCEIVER

BACKGROUND OF THE INVENTION

The present invention relates generally to vehicle safety warning systems.

Existing safety warning systems include a transmitter which can selectively send any of a plurality of warning messages relating to highway construction, accidents, stopped or slow moving vehicles, etc. The transmitter is installed on emergency vehicles or at road construction sites or other potentially hazardous areas. The transmitter sends the warning signal which is received by vehicles with safety warning receivers within the receiving range, up to one and a half miles. Many current radar detectors include safety warning receivers.

The existing system is infrastructure dependent and does not provide early warning of a road hazard until the system is activated by an emergency vehicle, often long after the incident occurs.

SUMMARY OF THE INVENTION

The present invention provides a safety warning transceiver installed in a vehicle and including a receiver for receiving a wireless first warning signal, such as from a safety warning system or fast braking warning system from another vehicle. The transceiver also includes a first transmitter which generates a wireless second warning signal in response to the first receiver receiving the first warning signal. The second warning signal is preferably identical to the first warning signal, such that it can be received by a safety warning transceiver or receiver in a second vehicle. The warning signals also preferably include a counter incremented by each transceiver or a time tag to limit propagation of the signal. Thus, the range of any safety warning system transmitter or fast braking warning system is improved.

Further, the receiver and transmitter are also used with other vehicle wireless communication systems. For example, the receiver and transmitter also preferably function as a trainable transmitter for use with home security systems, such as garage door openers. Further, the receiver also receives a wireless coded signal from a portable fob transmitter for activating the remote keyless entry system of the vehicle.

Preferably, the safety warning transceiver is physically and electrically dockable into a docking station in an interior trim panel in the vehicle, such as a headliner. The safety warning transceiver can therefore be removed and installed in another vehicle having a similar docking station.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF A PREFERRED EMBODIMENT

Figure 1:
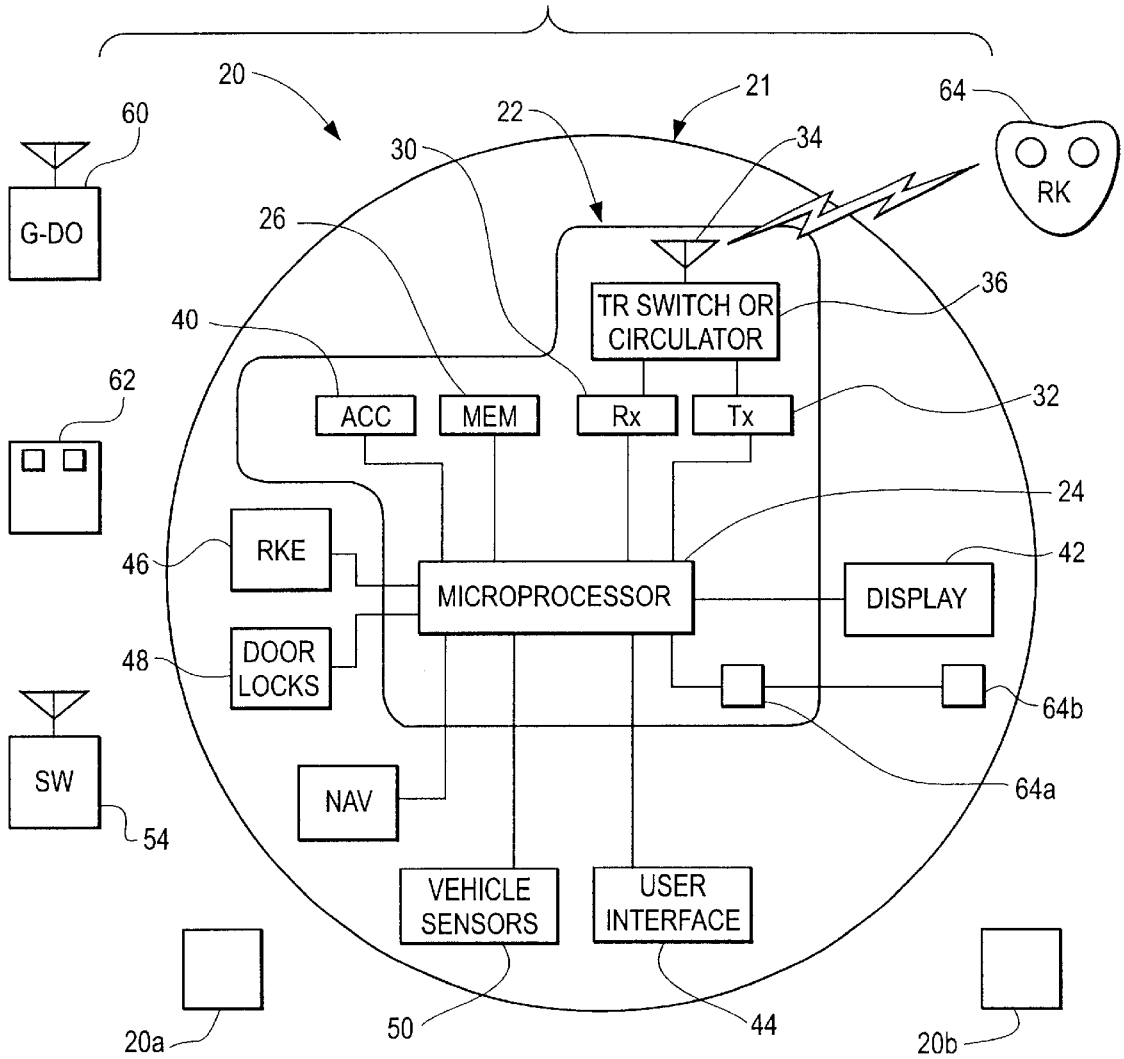
FIG. 1 is a schematic of the safety warning system of the present invention.

A safety warning system 20 according to the present invention is shown schematically in FIG. 1. The safety warning system 20 includes a safety warning transceiver 22 mounted in a vehicle 21. The safety warning transceiver 22 includes a microprocessor 24 which performs and coordinates the operation of the invention as will be described below. The microprocessor 24 is connected to a memory 26, comprising RAM and/or ROM. The safety warning transceiver 22 includes a receiver 30 and transmitter 32, which may be RF, microwave, etc., but preferably include the ability to send and receive signals in the existing safety warning systems described above. Further, as will be described below, the receiver 30 and transmitter 32 are also capable of receiving and transmitting wireless signals for garage door openers or other home security systems as well as remote keyless entry systems. The receiver 30 and transmitter 32 may share a single antenna 34 via a T/R switch or circulator 36.

The microprocessor 24 also receives a signal from an accelerometer 40 mounted in the safety warning transceiver 22 which provides information to the microprocessor indicating a fast braking situation by the vehicle 21. When the safety warning transceiver 22 is mounted in a vehicle, the microprocessor 24 is also connected to a display 42 and a user interface or user input device 44, such as a keyboard, buttons, joystick, mouse, microphone, etc. When the safety warning transceiver 22 is installed in a vehicle, the microprocessor 24 is also connected to the vehicle's remote keyless entry system 46 including the door lock actuators 48. The microprocessor 24 also receives input from various vehicle sensors 50 which may indicate speed or position of the vehicle or engine RPM.

The microprocessor 24 is programmed to perform the functions described herein. One reasonably skilled in the art would be able to program the microprocessor 24 to perform these functions, which are best described with respect to the interaction of the safety warning system 20 with several other systems, including a safety warning transmitter 54, identical safety warning systems 20*a,b* installed in second and third vehicles, a garage door opener receiver 60 (or other home security system) as is commercially available and commonly in use, together with its original remote transmitter 62, and a remote keyless entry fob 64. The components of the safety warning system 20 preferably interact with all of these other systems and components. Efficiency and reduced cost are achieved by the fact that these components perform multiple functions that interact with multiple other systems.

First, the safety warning system 20 receives wireless warning signals from a safety warning transmitter 54, which may be installed on an emergency vehicle or at a road construction site or other hazard. As is known the safety warning transmitter 54 generates a beacon wireless signal indicating the type of road hazard at the location of the transmitter. The safety warning system 20 of the present invention receives this signal via antenna 34 and receiver 30. The microprocessor 21 decodes this signal and generates an indication of the hazard on the display 42 to the driver of the vehicle 21. Additionally, the microprocessor 24 retransmits the warning signal via the transmitter 32 and antenna 34 so that it may also be received by other vehicles having similar safety warning systems 20*a,* 20*b* or at least safety warning receivers. The second warning signal generated by transmitter 32 in safety warning transceiver 22 is preferably identical to the first warning signal received by the receiver 30.

The safety warning system 20 also acts as a fast braking warning system, more fully disclosed in co-pending application Ser. No. 09/099,084, filed on Jun. 17, 1998, entitled "Fast Braking Warning System," which is hereby incorporated by reference. Generally, when the vehicle sensors 50 and/or accelerometer 40 sense that the vehicle 21 is slowing suddenly, a fast braking warning signal is generated by microprocessor 24 and sent via transmitter 32 and antenna 34 so indicating to vehicles behind vehicle 21. The safety warning system 20 also propagates such signals from other vehicles 21.

The warning signals (safety warning signals or fast braking warning signals) also preferably include a propagation limit code, such as a counter which is analyzed and incremented by the microprocessor 24. If the counter exceeds a predetermined value, such as twenty, the microprocessor 24 (in any of the systems 20, 20*a*, 20*b*) does not retransmit the signal. Alternatively, the original warning signal may include a time tag indicating when the signal was generated. Each microprocessor 24 compares the time tag to a current synchronized time base (such as derived from a GPS receiver) and retransmits the warning signal only if the difference is less than a predetermined time period, such as one minute. This value would depend upon the delay introduced by each retransmission; if each retransmission introduces three seconds of delay, this will again impose a cutoff of approximately twenty vehicles. Other values for determining threshold cutoff values can be selected.

The safety warning system 20 can also be utilized to activate a garage door opener 60 or other home security system. First, the safety warning system 20 is placed in a learning mode by the user interface 44, such as by pressing a button. The original transmitter 62 is then activated, generating a coded digital signal at a frequency which is received by antenna 34 and receiver 30. The microprocessor 24 determines the digital code and frequency, which are stored in memory 26. Subsequently, in operation mode, when the user activates a button and the user interface 44 associated with the garage door function, the microprocessor 24 retrieves the code and frequency from memory 26 and generates an appropriate wireless coded signal via transmitter 32 and antenna 34 to the garage door opener 60, thereby opening or closing the garage door. The safety warning system 20 can also learn encrypted codes according to known techniques. One preferred technique is more fully disclosed in co-pending application Ser. No. 09/140,022, entitled "Reconfigurable Universal Trainable Transmitter" filed on Aug. 26, 1998, which is hereby incorporated by reference. A preferred technique for determining the frequency of the original transmitter is disclosed in co-pending application Ser. No. 09/027,323 filed Feb. 20, 1998, entitled "Multiple-Frequency Programmable Transmitter," which is hereby incorporated by reference.

Tamper detection circuitry 64*a, b* is installed in the safety warning transceiver 22 and vehicle 21, respectively. The tamper detection circuitry 64*a* indicates to the microprocessor 24 when the safety warning transceiver 22 is removed from the vehicle 21. The tamper detection circuitry 64*a* may simply monitor power to the safety warning transceiver 22, or include an interlock connection to the vehicle 21 such as an electrical connection to the vehicle body which when broken indicates that the safety warning transceiver 22 has been removed from the vehicle 21. Alternatively, the tamper detection circuitry 64*a* may include an LED which reflects light from a surface on the vehicle 21; when the safety warning transceiver 22 is removed from the vehicle 21, the light is no longer reflected from the LED off of the vehicle surface, thereby indicating that the safety warning transceiver 22 has been removed.

When the tamper detection circuitry 64*a* detects that the safety warning transceiver 22 has been removed from the vehicle 21, the safety warning transceiver may be rendered unusable in one of several ways. First, the microprocessor 24 can erase the data from the memory 26. In this manner, if the safety warning transceiver is installed in the vehicle 21, unauthorized removal and use can be prevented.

Preferably, the tamper detection circuitry 64*a* is utilized only with a safety warning transceiver 22 which is permanently installed in the vehicle 21. This feature is more complicated to implement in combination with the feature of making the safety warning transceiver 22 dockable as well; however, in that case authorized use may be indicated through entry of a code entered via the user interface 44 or transmitted from an authorized fob 64. Further, as another alternative, upon detection of tampering by the tamper detection circuitry 64*a*, only circuitry and/or data necessary to generate codes for the garage door opener 60 are disabled, and not the features of the safety warning transceiver 22 that provide fast braking warning or safety warning signals.

Figure 2:
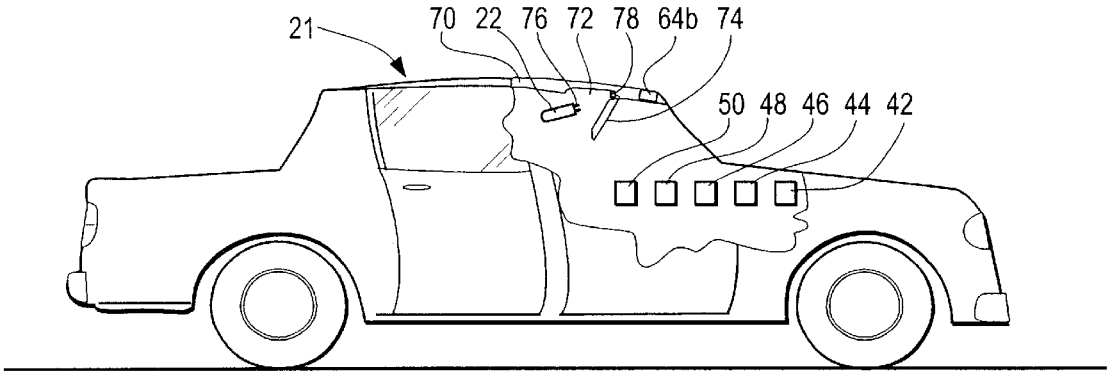
FIG. 2 illustrates one way of installing the safety warning transceiver of FIG. 1 into a vehicle.

FIG. 2 illustrates schematically how the safety warning transceiver 22 is installed in a vehicle 21. The vehicle 21 includes the display 42, user interface 44, remote keyless entry system 46, door lock actuators 48 and vehicle sensors 50. The safety warning transceiver 22 is preferably removably mountable in a headliner 70 in the vehicle 21. The headliner 70 includes a docking station 72 which may include a hinged cover 74 or door. Electrical connectors 76 on the safety warning transceiver 22 mate with electrical connectors 78 and the docking station 72 to provide the electrical connections shown in FIG. 1 when the safety warning transceiver 22 is installed in the docking station 72. As described above, the docking station 72 may also include the tamper detection circuitry 64*b*. In this manner, the safety warning transceiver 22 may be removed by the consumer selectively from the vehicle 21 to prevent theft, or alternatively, install into another vehicle having a similar docking station 72. Alternatively, the safety warning transceiver 22 could be permanently installed in headliner 70 or other interior trim panel.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. Unless otherwise specified in the claims, alphanumeric labeling of steps or substeps in method claims below do not specify a sequence in which the steps or substeps are to be performed.

What is claimed is:

1. A method for communicating a warning signal including the steps of:

(a) receiving a wireless first warning signal in a first vehicle, said first warning signal including a first propagation limit code indicative of whether a wireless second warning signal containing a second propagation limit code should be transmitted;

(b) analyzing said first propagation limit code in said first warning signal; and (c) transmitting said wireless second warning signal from the first vehicle in response to said step (a) and based upon said step (b).

2. The method of claim 1, further including the step of:

(d) transmitting said first warning signal from a first location remote from said first vehicle before said step (a).

3. The method of claim 2, further including the step of:

(e) receiving the second warning signal in a second vehicle.

4. The method of claim 3, further comprising the step of (f) slowing said second vehicle in response to said step (e).

5. The method of claim 1, wherein said first propagation limit code is a counter, said method further including the steps of:

(d) incrementing said counter;

(e) transmitting said second warning signal in said step (c) along with said incremented counter as said second propagation limit code only if said counter is below a counter limit.

6. A safety warning system comprising:

a safety warning transceiver comprising a first receiver and a first transmitter, said first receiver being for receiving a wireless first warning signal from a first direction, and said first transmitter being for generating a wireless second warning signal in response to said first receiver receiving said first warning signal and transmitting said second warning signal in a second direction different from the first direction.

7. The safety warning system of claim 6, further including:

a second transmitter for transmitting said first wireless warning signal from a location remote from said safety warning transceiver, said safety warning transceiver being portable relative to said second transmitter.

8. The safety warning system of claim 6, wherein said first and second warning signals each indicate a type of road hazard.

9. The safety warning system of claim 8, wherein said first and second warning signals both indicate that a vehicle accident has occurred.

10. A safety warning system comprising:

a safety warning transceiver comprising a first receiver and a first transmitter, said first receiver being for receiving a wireless first warning signal containing a first type of information, and said first transmitter being for generating a wireless second warning signal in response to said first receiver receiving said first warning signal, said safety warning system further including code generation circuitry, said first transmitter selectively generating a wireless coded signal received from said code generation circuitry containing a second type of information different from the first type of information, wherein said wireless coded signal is a garage door opener signal.

11. A safety warning system comprising:

a safety warning transceiver comprising a first receiver and a first transmitter, said first receiver being for receiving a wireless first warning signal containing a first type of information, and said first transmitter being for generating a wireless second warning signal in response to said first receiver receiving said first warning signal, said safety warning system further including code generation circuitry, said first transmitter selectively generating a wireless coded signal received from said code generation circuitry containing a second type of information different from the first type of information, wherein said code generation circuitry includes a memory, said first receiver being for selectively storing code generation data in said memory, and said code generation circuitry being for generating said wireless coded signal based upon said code generation data.

12. The safety warning system of claim 11, wherein said code generation data indicates a frequency, said first transmitter generating said wireless coded signal at said frequency based upon said code generation data.

13. The safety warning system of claim 12, wherein said transmitter is capable of generating a plurality of frequencies.

14. A safety warning system comprising:

a safety warning transceiver comprising a first receiver and a first transmitter, said first receiver being for receiving a wireless first warning signal, and said first transmitter being for generating a wireless second warning signal in response to said first receiver receiving said first warning signal; and code analyzing circuitry for analyzing a code in a wireless first coded signal received by said first receiver and generating a door lock activation signal based upon said analysis of said first coded signal.

15. The safety warning system of claim 14, further including:

a portable fob including a second transmitter for generating said wireless first coded signal.

16. A safety warning system comprising:

a safety warning transceiver comprising a first receiver and a first transmitter, said first receiver being for receiving a wireless first warning signal, and said first transmitter being for generating a wireless second warning signal in response to said first receiver receiving said first warning signal, wherein said first warning signal includes a propagation limit code, said first transmitter generating said second warning signal based upon said propagation limit code.

17. The safety warning system of claim 16, wherein said propagation limit code comprises a counter, said safety warning transceiver incrementing said counter and transmitting said second warning signal along with said incremented counter.

18. A safety warning system comprising:

a docking station installed in a vehicle interior trim panel, said docking station including a first connector; and a safety warning receiver capable of receiving a wireless first warning signal, said safety warning receiver including a second connector matable with said first connector of said docking station.

19. The safety warning system of claim 18, wherein said first and second connectors are electrical connectors.

20. The safety warning system of claim 14, further including:

a second transmitter for transmitting said first wireless warning signal from a location remote from said safety warning transceiver, said safety warning transceiver being portable relative to said second transmitter.

21. The safety warning system of claim 14, wherein said first and second warning signals each indicate a type of road hazard.

22. The safety warning system of claim 21, wherein said first and second warning signals both indicate that a vehicle accident has occurred.

23. The safety warning system of claim 16, further including:

a second transmitter for transmitting said first wireless warning signal from a location remote from said safety warning transceiver, said safety warning transceiver being portable relative to said second transmitter.

24. The safety warning system of claim 16, wherein said first and second warning signals each indicate a type of road hazard.

25. The safety warning system of claim 24, wherein said first and second warning signals both indicate that a vehicle accident has occurred.

26. A device for operation in a first vehicle for communicating a warning signal comprising:

receiving means for receiving a wireless first warning signal in said first vehicle, said first warning signal including a first propagation limit code indicative of whether a wireless second warning signal containing a second propagation limit code should be transmitted;

analyzing means for analyzing said first propagation limit code in said first warning signal; and transmitting means for transmitting said wireless second warning signal from the first vehicle in response to said receiving means receiving said first warning signal and based upon an analysis of said first propagation limit code by said analyzing means.

27. The device of claim 26, wherein said first warning signal is transmitted from a first location remote from said first vehicle before said receiving means receives said first warning signal.

28. The device of claim 27, wherein the second warning signal is adapted to be received in a second vehicle.

29. The device of claim 28, wherein the second warning signal is for instructing the second vehicle to slow down.

30. The method of claim 26, wherein said propagation limit code is a counter, said device further including means for incrementing said counter, said transmitting means being for transmitting said second warning signal along with said incremented counter only if said counter is below a counter limit.

* * * * *